US006976530B2

(12) United States Patent
Hayashi et al.

(10) Patent No.: US 6,976,530 B2
(45) Date of Patent: Dec. 20, 2005

(54) EXHAUST HEAT EXCHANGER

(75) Inventors: Takayuki Hayashi, Aichi-gun (JP); Youji Yamashita, Hidaka (JP)

(73) Assignees: DENSO Corporation, Kariya (JP); Sankyo Radiator Co., Ltd., Tokyo (JP)

( * ) Notice: Subject to any disclaimer, the term of this patent is extended or adjusted under 35 U.S.C. 154(b) by 0 days.

(21) Appl. No.: 10/603,971

(22) Filed: Jun. 25, 2003

(65) Prior Publication Data

US 2004/0035566 A1 Feb. 26, 2004

(30) Foreign Application Priority Data

Jun. 28, 2002 (JP) ..... 2002-189572

(51) Int. Cl.[7] ..... F28D 7/10

(52) U.S. Cl. ..... 165/157; 165/52; 165/158; 123/568.12

(58) Field of Search ..... 165/51, 143, 158; 123/568.12; 60/320, 278

(56) References Cited

U.S. PATENT DOCUMENTS

| | | | | |
|---|---|---|---|---|
| 4,993,485 A | * | 2/1991 | Gorman | 165/85 |
| 6,161,528 A | * | 12/2000 | Akao et al. | 123/568.12 |
| 6,595,274 B2 | * | 7/2003 | Hayashi et al. | 165/158 |

FOREIGN PATENT DOCUMENTS

| | | | | |
|---|---|---|---|---|
| DE | 3212913 | * | 10/1983 | 165/51 |
| DE | 101 02 483 | | 8/2002 | |
| FR | 2 830 929 | | 11/2002 | |
| JP | 11-241891 | * | 2/1998 | 165/51 |
| JP | 11-237192 | * | 8/1999 | 165/51 |
| JP | 11-303688 | * | 11/1999 | 165/51 |
| JP | 2001-108390 | | 4/2001 | |
| WO | WO 03/25380 | * | 3/2003 | 165/51 |

OTHER PUBLICATIONS

Patent Abstracts of Japan No. 2001-108390 dated Apr. 20, 2001.

* cited by examiner

*Primary Examiner*—Terrell McKinnon
(74) *Attorney, Agent, or Firm*—Harness, Dickey & Pierce, PLC

(57) ABSTRACT

A profile of the casing 20 is formed into a circular pipe shape, and the two gas coolers 10*a*, 10*b* are integrated into one body so that the longitudinal directions of the respective gas coolers can be substantially parallel with each other. Due to the above structure, it is possible to make the coolant flow smoothly in the casing 20 and stagnation of the coolant seldom occurs. Accordingly, as boiling of the coolant can be suppressed, it is possible to prevent the heat transfer coefficient from being remarkably deteriorated. Further, it is possible to suppress the generation of cracks, in the tubes 11, which are caused by heat stress.

10 Claims, 6 Drawing Sheets

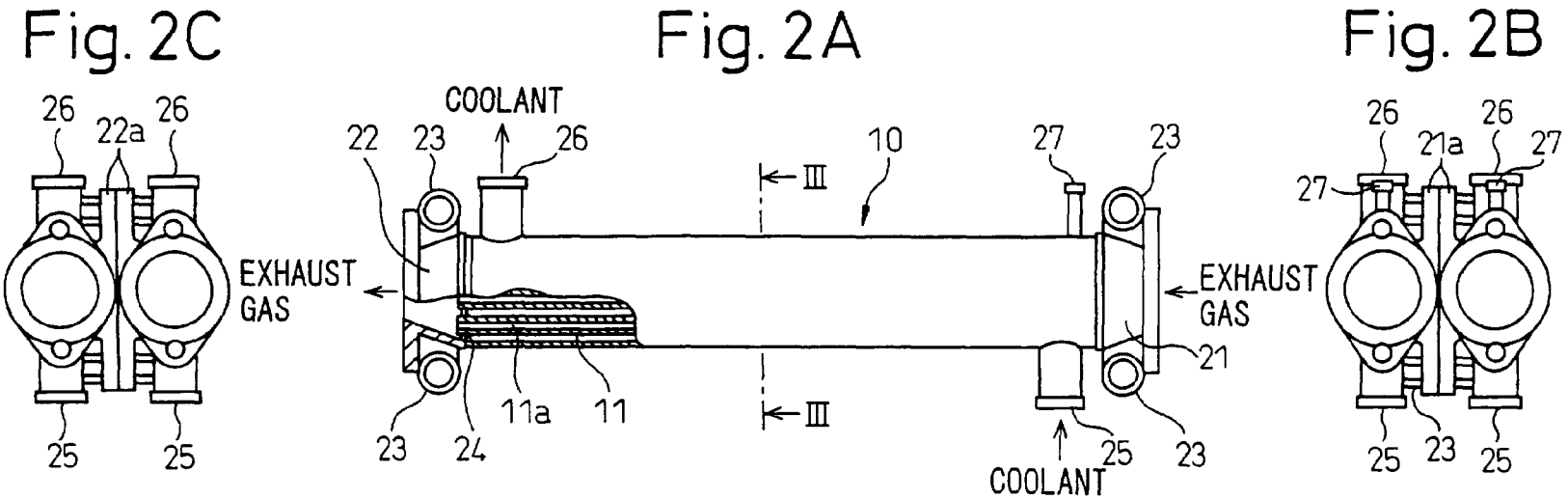
Fig. 2B
Fig. 2A
Fig. 2C
EXHAUST GAS
COOLANT
EXHAUST GAS
COOLANT
10
11
11a
21
21a
22
22a
23
24
25
26
27
III
III
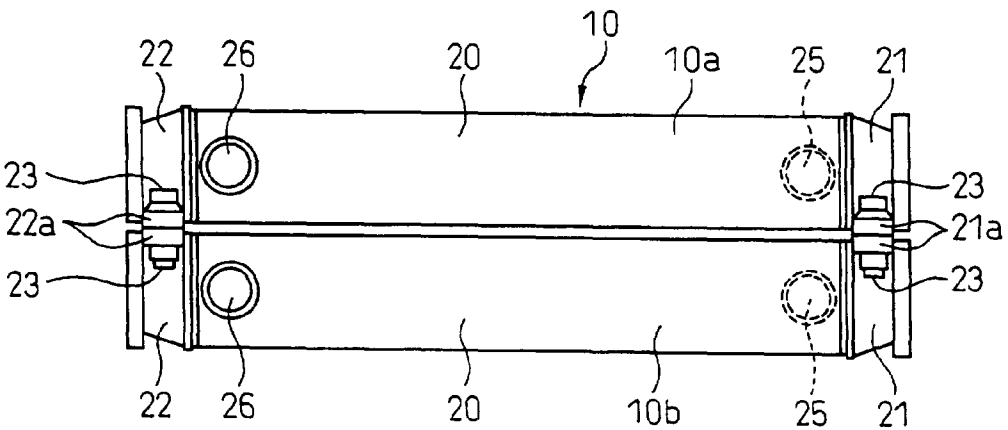
Fig. 2D
10
10a
10b
20
21
21a
22
22a
23
25
26

EXHAUST HEAT EXCHANGER

BACKGROUND OF THE INVENTION

1. Field of the Invention

The present invention relates to an exhaust heat exchanger for exchanging heat between an exhaust gas, which has been discharged from a heat engine (especially, the exhaust gas which has been discharged from an internal combustion engine), and a coolant used to cool the heat engine. The present invention is effectively applied to a gas cooler for cooling the exhaust gas used for an EGR (exhaust gas recirculation) device.

2. Description of the Related Art

As a gas cooler used for EGR device, a multitube type heat exchanger (for example, a multitube type heat exchanger disclosed in Japanese Unexamined Patent Publication No. 2001-108390) is well known. This multitube type heat exchanger includes: a casing formed into a shell having an inlet and outlet for the coolant; a tube seat, which is accommodated in the casing, for supporting a large number of exhaust gas pipes; and bonnets arranged on both sides of the casing, in which an inlet and outlet of the exhaust gas are formed.

In this connection, as stringent regulations have been recently adopted against exhaust gas emissions, to reduce a quantity of NOx contained in the exhaust gas, it is desired to enhance the cooling performance of an EGR gas cooler.

In the case where the multitube type heat exchanger described in the above prior art is used for the gas cooler, in order to enhance the cooling performance, it is possible to adopt a structure where the length of the exhaust pipe is extended so as to increase a heat exchanging area of the heat exchanger.

However, when the length of the exhaust pipe is extended, there is caused a problems in which a vibration proof property, with respect to the vibration generated in a vehicle, is deteriorated.

In order to solve the above problems, when the number of exhaust gas pipes is increased so as to enhance the cooling performance, a size of the gas cooler in the direction perpendicular to the longitudinal direction is extended, that is, a size of the cross section of the gas cooler is extended.

However, as shown in FIG. 6, a space in the engine compartment in which the gas cooler is mounted is not sufficiently large in the vertical direction. In detail, various components such as an intake manifold and others are arranged in an upper portion of the EGR gas cooler. Therefore, it is impossible to provide a sufficiently large space for the gas cooler in the vertical direction. Accordingly, it is difficult for a multitube type heat exchanger, the number of exhaust pipes of which is increased, to be mounted on a vehicle.

In order to solve the above problems, the present inventors made investigations and produced the multitube type heat exchanger shown in FIG. 5, by way of a trial, in which the casing is formed into a flat rectangle. However, the following new problems may be encountered in this multitube type heat exchanger.

In the multitube type heat exchanger, which was produced by way of trial, the cross section of the casing is rectangular. Therefore, a current of the coolant flowing in the casing is remarkably deteriorated. Accordingly, there is a tendency for the occurrence of stagnation of the coolant in which the coolant hardly flows. When stagnation is caused in the current of the coolant, the coolant boils, and the heat transfer coefficient is remarkably lowered. Further, as the temperature of the exhaust gas passage is increased, cracks tend to occur, due to heat, in the tubes composing the exhaust gas passage.

SUMMARY OF THE INVENTION

The present invention has been accomplished in view of the above points. It is a first object of the present invention to provide a new exhaust heat exchanger different from the exhaust heat exchanger of the prior art. It is a second object of the present invention to enhance the cooling capacity of an exhaust heat exchanger without deteriorating the durability and the heat exchange efficiency (the heat transfer coefficient).

In order to accomplish the above objects, the present invention provides an exhaust heat exchanger for exchanging heat between an exhaust gas generated by combustion and a coolant, comprising: at least two casings (20) composing a coolant passage (16) in which the coolant flows, formed into a circular pipe shape; and heat exchanging cores respectively arranged in the two casings (20), having an exhaust gas passage **(11*a*) in which the exhaust gas flows, wherein both casings (20)** are integrated with each other into one body so that the longitudinal directions of the casings can be substantially parallel with each other.

In the present invention, the casing (20) is formed into a circular pipe shape. Therefore, it is possible for the coolant flowing in the casing (20) to flow smoothly. Therefore, stagnation seldom occurs in the current of the coolant. Accordingly, it is possible to prevent the coolant from boiling, and it is also possible to prevent the heat transfer coefficient from remarkably deteriorating. Further, it is possible to prevent the occurrence of cracks, which are generated by thermal stress, in the components composing the exhaust gas passage **(11*a*)**.

As at least two casings (20) are integrated into one body, so that the respective longitudinal directions can be substantially parallel with each other, it is possible to increase a total heat exchanging area between the exhaust gas and the coolant without increasing the size in the longitudinal direction of the exhaust heat exchanger. In this way, it is possible to provide a new exhaust heat exchanger different from the conventional one.

As described above, according to the exhaust heat exchanger of the present invention, it is possible to enhance the cooling capacity without lowering the durability and the heat exchanging efficiency (the heat transfer coefficient).

In the present invention, it is preferable that a cross section of the exhaust gas passage **(11*a*)** is circular.

In the present invention, it is also preferable that bonnets (21, 22) for closing the longitudinal direction of the casing (20) and-communicating the exhaust gas passage **(11*a*) with the exhaust gas pipe (30) are provided at both end portions of the two casings (20) in the longitudinal direction, and the two casings (20) are integrated into one body by the bonnets (21, 22)**.

Further, in the present invention, it is preferable that the two casings (20) are integrated into one body by a detachable joining means (23).

The present invention may be more fully understood from the description of preferred embodiments of the invention, as set forth below, together with the accompanying drawings.

BRIEF DESCRIPTION OF THE DRAWINGS

In the drawings:

FIGS. 2A to 2D are four side views of a gas cooler of the embodiment of the present invention;

DESCRIPTION OF THE PREFERRED EMBODIMENTS

Figure 1:
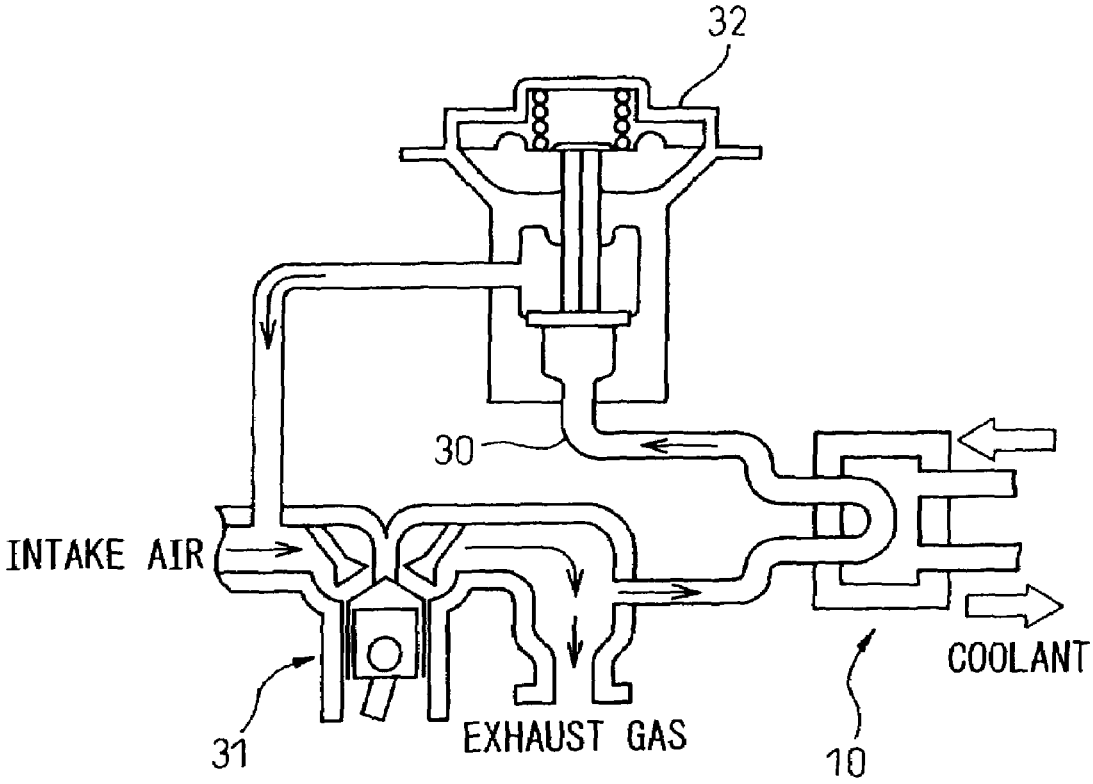
FIG. 1 is a schematic illustration showing a model of an EGR gas cooling device in which a gas cooler of the embodiment of the present invention is used.

In this embodiment, an exhaust heat exchanger of the present invention is applied to an exhaust gas cooling device used for a Diesel engine. FIG. 1 is a schematic illustration showing a model of an EGR gas cooling device (exhaust gas recirculating device) in which an exhaust gas cooling device of an embodiment of the present invention is used. This exhaust gas cooling device will be referred to as a gas cooler 10, hereinafter.

The exhaust gas recirculating pipe 30 is a pipe used for recirculating one portion of the exhaust gas, which has been discharged from the engine 31, to the intake side of the engine 31.

The EGR valve 32, which is of a well-known type, is arranged in the middle of the flow of exhaust gas of the exhaust gas recirculating pipe 30 and adjusts the quantity of exhaust gas according to a state of operation of the engine 31. The gas cooler 10 is arranged between the exhaust side of the engine 31 and the EGR valve 32 and exchanges heat between the exhaust gas and the engine coolant so as to cool the exhaust gas.

Next, the structure of the gas cooler 10 will be described below.

Figure 3:
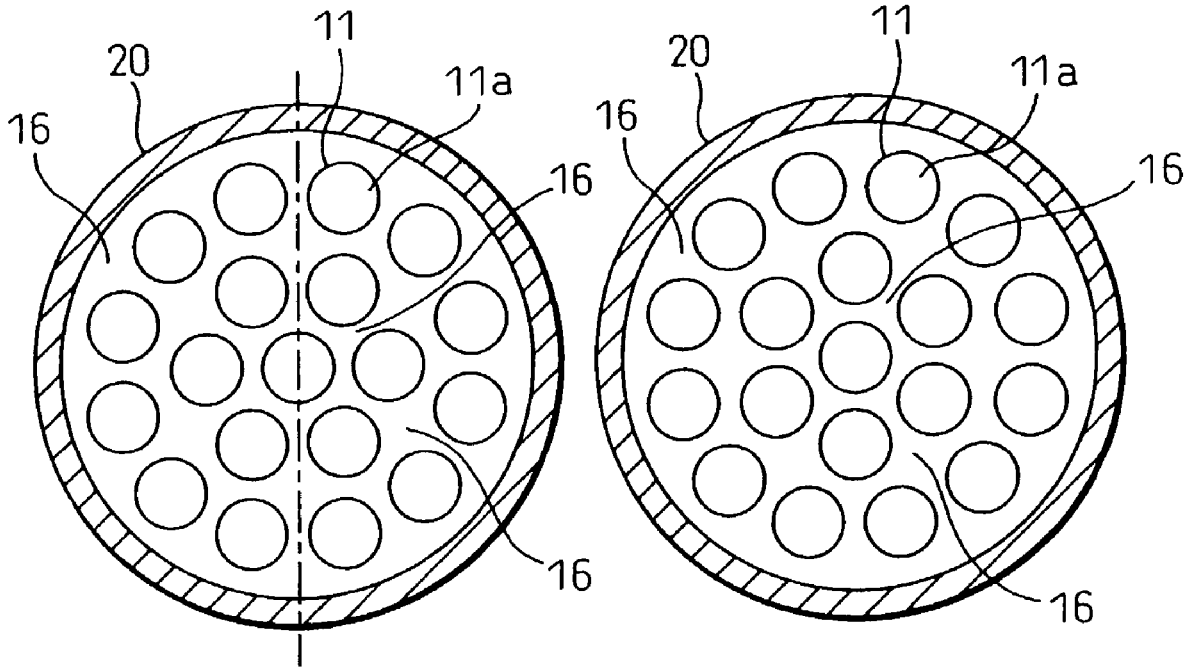
FIG. 3 is a sectional view taken on line III—III in FIG. 2A.

FIGS. 2A to 2D are four side views of the gas cooler 10 and FIG. 3 is a sectional view taken on line III—III in FIG. 2A. As shown in FIGS. 2B to 2D, this gas cooler 10 is composed in such a manner that two gas coolers, the shapes of which are the same, are arranged in the horizontal direction so that the longitudinal directions of the two gas coolers are substantially parallel with each other, and the two thus-arranged gas coolers are integrated into one body. The gas cooler located on the upper side of the FIG. 2D is referred to as a first gas cooler 10*a*, and the gas cooler located on the lower side of the FIG. 2D is referred to as a second gas cooler 10*b*.

The structure-of the first and the second gas cooler 10*a*, 10*b* will be described while the first gas cooler 10*a* is taken as an example for the explanation.

As shown in FIG. 3, the tube 11 is a circular pipe, that is, the tube 11 is a pipe, the cross section of which is circular, composing the exhaust gas passage 11*a* in which the exhaust gas circulates. The casing 20 accommodates the heat exchanging core composed of a plurality of tubes 11 which are arranged on a concentric circle at regular intervals. The casing 20 is formed into a circular pipe shape in which the coolant passage 16 is provided so that the coolant can be circulated around the heat exchanging core.

In this connection, the tube 11 and the casing 20 are made of metal, the anticorrosion property of which is excellent. In this embodiment, the tube 11 and the casing 20 are made of stainless steel.

As shown in FIG. 2D, in the opening portion on one end side of the casing 20 in the longitudinal direction, that is, on the right of the casing 20, there is provided a tank portion, which is arranged so that it can close this opening portion, for distributing and supplying the exhaust gas to the tubes 11. The first bonnet 21 for connecting the exhaust gas recirculating pipe 30 is soldered or welded to the opening portion. On the other hand, in the opening portion of the other end side of the casing 20 in the longitudinal direction, that is, on the left of the casing 20, there is provided a tank portion for collecting and recovering the exhaust gas, which has completed a heat exchange, from the tubes 11. The second bonnet 22 for connecting the exhaust gas recirculating pipe 30 is soldered or welded to the opening portion.

Figure 4:
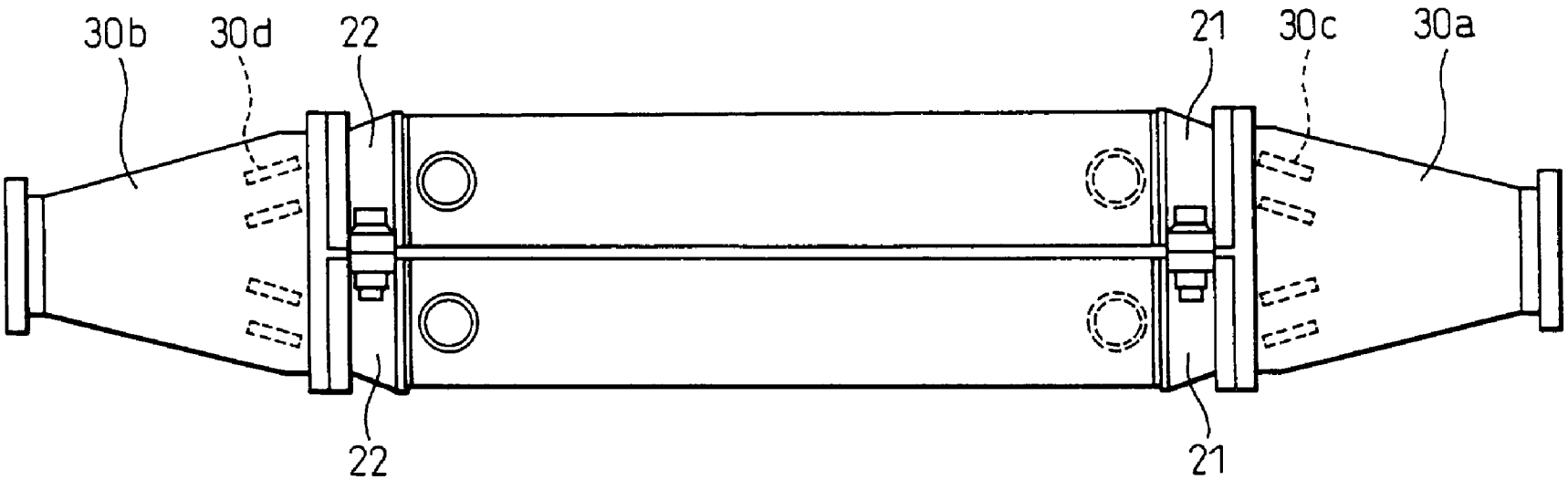
FIG. 4 is an appearance view of a gas cooler of the embodiment of the present invention.
Figure 5:
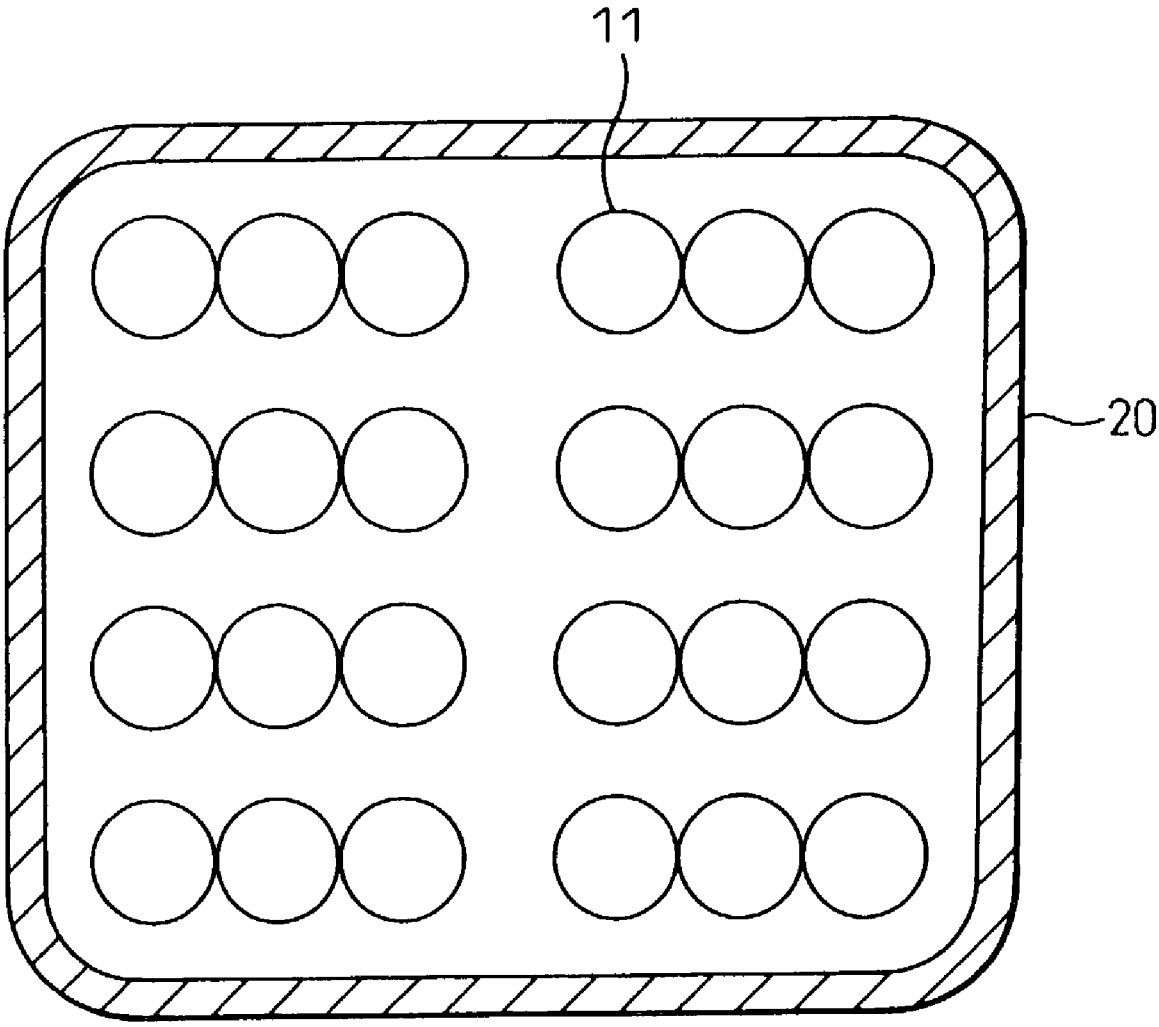
FIG. 5 is a sectional view of gas cooler into which investigations were made for trial production.
Figure 6:
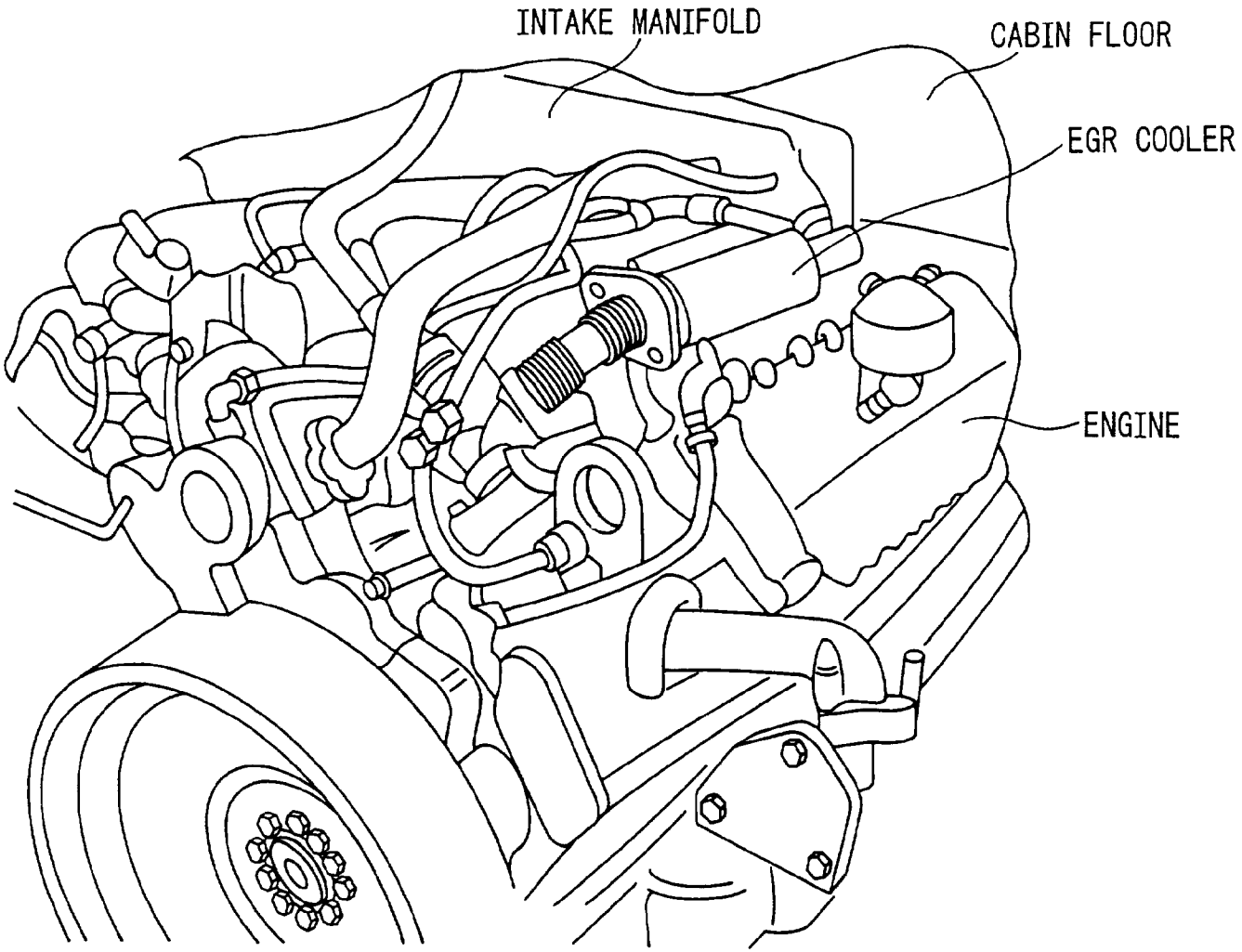
FIG. 6 is a schematic illustration showing a state in which an EGR gas cooling device is arranged in an engine compartment.

In this connection, as shown in FIG. 4, the distributor 30*a* for distributing the exhaust gas supplied from the exhaust gas recirculating pipe 30 to the first and the second gas cooler 10*a*, 10*b* is connected with the first bonnet 21, and the collector 30*b* for collecting the exhaust gas flowing out from the first and the second gas cooler 10*a*, 10*b* is connected with the second bonnet 22.

In this connection, in the distributor 30*a*, there is provided a distributing guide 30*c* for smoothly distributing the exhaust gas. In the collector 30*b*, there is provided a collecting guide 30*d* for smoothly collecting the exhaust gas.

As shown in FIGS. 2A to 2D, in both bonnets 21, 22, there are provided insertion holes into which the bolts 23, which are a joining means for integrating the first and the second gas cooler 10*a*, 10*b*, are inserted. Further, in both bonnets 21, 22, there are integrally provided flange portions 21*a*, 22*a* in which the joining faces of the first and the second gas cooler 10*a*, 10*b*, are formed.

The core plate 24 holds the tubes 11 and partitions the coolant passage 16 and the tank portion. This core plate 24 and the first and the second bonnet 21, 22 are made of metal, the anticorrosion property of which is excellent. In this embodiment, the core plate 24 and the first and the second bonnet 21, 22 are made of stainless steel.

On one side of the casing 20 into which the exhaust gas flows, there is provided an inlet 25 from which the coolant is introduced into the coolant passage 16. On the other side of the casing 20 from which the exhaust gas flows out, there is provided an outlet 26 from which the coolant, which has exchanged heat, is discharged.

In this connection, the bypass port 27 is located at a position on the side of the casing 20 opposite to the inlet 25. Therefore, one portion of the coolant flowing into the casing 20 is made to go round the heat exchanging core and is introduced to the side of the gas cooler 10 from which the coolant flows out. By this bypass port 27, the coolant on the opposite side to the inlet 25, which tends to stagnate, is made to positively flow, so that the occurrence of stagnation can be prevented.

Next, the operational effect of this embodiment will be explained below.

In this embodiment, as the profile of the casing 20 is formed into a circular pipe shape, the coolant can smoothly flow in the casing 20, and stagnation of the coolant seldom occurs. Accordingly, it is possible to suppress boiling of the coolant. Therefore, it is possible to prevent the heat transfer coefficient from being remarkably lowered. Further, it is possible to suppress the generation of cracks, in the tubes 11, which are caused by thermal stress.

In this connection, when the cross section of the casing is rectangular, stress concentration tends to occur at four corners of the cross section in the process of press forming. Accordingly, there is a high possibility that the mechanical strength of the casing is lowered and durability (reliability) of the vibration proof property is greatly deteriorated.

On the other hand, as the profile of the casing 20 is formed into a circular pipe shape in this embodiment, it is possible to prevent the occurrence of stress concentration in the process of forming the casing 20.

As at least two gas coolers 10*a*, 10*b* are integrated with each other into one body so that the longitudinal directions of the two gas coolers 10*a*, 10*b* can be parallel with each other, the size of the gas cooler in the longitudinal direction is not extended and the total heat exchanging area between the exhaust gas and the coolant can be increased.

As described above, in the gas cooler 10 of this embodiment, it is possible to enhance the cooling capacity without lowering the durability and the heat exchanging efficiency (heat transfer coefficient).

In the above embodiment, the exhaust heat exchanger of the present invention is applied to the gas cooler 10, however, the exhaust heat exchanger of the present invention may be applied to a heat exchanger, which is arranged in a muffler, for recovering heat energy from the exhaust gas.

In the embodiment described above, the two gas coolers 10*a*, 10*b* are integrated into one body by the bolts 23, however, the present invention is not limited to the above specific embodiment. For example, the two gas coolers 10*a*, 10*b* may be integrated into one body by means of soldering or welding.

In the embodiment described above, the two gas coolers 10*a*, 10*b* are integrated into one body, however, the present invention is not limited to the above specific embodiment. For example, not less than three gas coolers may be integrated into one body so that the longitudinal directions of the respective gas coolers can be substantially parallel with each other.

In the embodiment described above, the two gas coolers 10*a*, 10*b* are integrated into one body by the bonnets 21, 22, however, the present invention is not limited to the above specific embodiment.

In the embodiment described above, the distributor 30*a* and the collector 30*b* are connected with the bonnets 21, 22, however, the present invention is not limited to the above specific embodiment. For example, the first bonnet 21 And the distributor 30*a* may be integrated into one body, and the second bonnet 22 and the collector 30*b* may be integrated into one body.

While the invention has been described by reference to specific embodiments chosen for purpose of illustration, it should be apparent that numerous modifications could be made thereto by those skilled in the art without departing from the basic concept and scope of the invention.

What is claimed is:

1. An exhaust heat exchanger for exchanging heat between exhaust gas generated by combustion and coolant, comprising:

at least two casings, each casing defining a coolant passage in which the coolant flows, each casing being formed into a circular pipe shape; and heat exchanging cores respectively arranged in the at least two casings, each heat exchanging core having an exhaust gas passage in which the exhaust gas flows from a first longitudinal end to a second longitudinal end of the at least two casings, wherein the at least two casings are integrated into one body so that the longitudinal directions of the casings can be substantially parallel with each other; and a coolant inlet is provided at the first longitudinal end of each of the casings and a coolant outlet is provided at the second longitudinal end of each of said casings.

2. An exhaust heat exchanger according to claim 1, wherein a cross section of the exhaust gas passage is circular.

3. An exhaust heat exchanger according to claim 1, wherein bonnets for closing the first and second longitudinal ends of the casing and communicating the exhaust gas passage with the exhaust gas pipe are provided at both the first and second longitudinal ends of the two casings, and the at least two casings are integrated into one body by the bonnets.

4. An exhaust heat exchanger according to claim 1, wherein the at least two casings are integrated into one body by a detachable joining means.

5. An exhaust heat exchanger according to claim 1, wherein the at least two casings are arranged in parallel with each other in a substantially horizontal direction.

6. An exhaust heat exchanger according to claim 3, wherein each of the exhaust gas passages is defined by a plurality of tubes, the plurality of tubes being arranged on concentric circles both ends of the plurality of tubes being held by a respective core plate.

7. An exhaust heat exchanger according to claim 1 further comprising a bypass coolant outlet provided at the first longitudinal end of each of said casings to provide a bypass of the heat exchanger for a portion of the coolant.

8. An exhaust heat exchanger for exchanging heat between exhaust gas generated by combustion and coolant, the exhaust heat exchanger comprising:

at least two casings, each casing defining a coolant passage in which the coolant flows, each casing being formed into a circular pipe shape; and heat exchanging cores respectively arranged in each of the at least two casings, each heat exchanging core having an exhaust gas passage in which the exhaust gas flows from an inlet end of the exhaust gas passage to an outlet end of the exhaust gas passage, wherein a coolant inlet for each of the at least two casings is disposed adjacent the inlet end of the exhaust gas passages and a coolant outlet for each of the at least two casings is disposed adjacent the outlet end of the exhaust gas passages;

the at least two casings are integrated into one body so that the longitudinal directions of the casings can be substantially parallel with each other; and the at least two casings are integrated into one body by a detachable joining means.

9. An exhaust heat exchanger according to claim 8 further comprising a bypass coolant outlet provided at the inlet end of the exhaust gas passages to provide a bypass of the heat exchanger for a portion of the coolant.

10. An exhaust heat exchanger for exchanging heat between exhaust gas generated by combustion and coolant, comprising: at least two casings composing a coolant passage in which the coolant flows, formed into a circular pipe shape; and heat exchanging cores respectively arranged in the two casings, having an exhaust gas passage in which the exhaust gas flows from a first longitudinal end to a second longitudinal end of the two casings, wherein both casings are integrated into one body so that the longitudinal directions of the casings can be substantially parallel with each other; and a coolant inlet is provided at one of the first and second longitudinal ends of each of the casings, a coolant outlet is provided at the other of the first and second longitudinal ends of each of said casings, and a bypass coolant outlet is provided at the one of the first and second longitudinal ends of each of said casings to provide for a bypass of the heat exchanger for a portion of the coolant.

* * * * *